US005148950A

United States Patent [19]

Hosaka

[11] Patent Number: 5,148,950

[45] Date of Patent: Sep. 22, 1992

[54] HELMET AND FLUID RESERVOIR APPARATUS

[76] Inventor: Dave K. Hosaka, 6652 S. Alta, Reedley, Calif. 93654

[21] Appl. No.: 760,113

[22] Filed: Sep. 16, 1991

[51] Int. Cl.[5] ..... B67D 5/62

[52] U.S. Cl. ..... 222/175; 222/192; 224/30 A; 224/148; 224/181; 422/2

[58] Field of Search ..... 222/175, 192; 224/30 A, 224/148, 181; 2/2.1 A, 6, 185 R, 199, 410, 422, 424; 280/288.4

[56] References Cited

U.S. PATENT DOCUMENTS

| | | | |
|---|---|---|---|
| 4,095,812 | 6/1978 | Rowe | 280/288.4 |
| 4,681,244 | 7/1987 | Geddie | 222/175 |
| 4,739,805 | 4/1988 | Nelson | 222/175 |
| 4,813,083 | 3/1989 | Davidson | 2/422 |
| 4,921,141 | 5/1990 | Branum | 2/185 R |
| 5,002,591 | 11/1991 | Runtrel | 222/175 |

*Primary Examiner*—Kevin P. Shaver
*Assistant Examiner*—Philippe Derakshani
*Attorney, Agent, or Firm*—Leon Gilden

[57] ABSTRACT

A helmet structure includes a separably movable fluid pouch mounted within the helmet below the forward helmet shell opening, including an "L" shaped conduit directed upwardly and mounted medially to a respective right and left fluid cavity of the reservoir structure. The organization utilizes hook and loop fastener tabs mounted to a forward surface of the right and left reservoirs for mounting to an interior fibrous surface of the helmet shell. A modification of the invention includes a storage tank mounted to the handle bar structure of an associated motorcycle or bicycle construction utilizing a storage tank conduit hose in communication with a valve mounted to the storage tank to direct fluid to the right and left reservoir pouches.

5 Claims, 4 Drawing Sheets

HELMET AND FLUID RESERVOIR APPARATUS

BACKGROUND OF THE INVENTION

1. Field of the Invention

The field of invention relates to helmet apparatus, and more particularly pertains to a new and improved helmet and fluid reservoir apparatus wherein the same is arranged for the storage and availability of fluids for use by motorcycle and bicycle riders.

2. Description of the Prior Art

In motorcycle and bicycle racing, typically dusty and sandy conditions persist wherein due to physical exertion by a rider, physical endurance is tested with an associated result of water loss due to evaporation. Apparatus available in the prior art is exemplified in U.S. Pat. No. 4,813,083 to Davidson setting forth a helmet with a water storage supply mounted in a rigid visor construction of the helmet. In this manner, the visor maintains a rigid construction where its positioning at an upper end of the helmet may impart an imbalance in the use of the helmet structure when worn by a rider.

U.S. Pat. No. 4,369,782 to McGee sets forth a helmet structure wherein an eye washing apparatus is mounted within a reservoir contained within an upper portion of the helmet structure.

As such, it may be appreciated that there continues to be a need for a new and improved helmet and fluid reservoir apparatus as set forth by the instant invention which addresses both the problems of ease of use as well as effectiveness in construction in providing selective replenishment of fluids for use by a motorcycle or bicycle rider and in this respect, the present invention substantially fulfills this need.

SUMMARY OF THE INVENTION

In view of the foregoing disadvantages inherent in the known types of helmet apparatus now present in the prior art, the present invention provides a helmet and fluid reservoir apparatus wherein the same utilizes a flexible reservoir member mounted within an interior surface of the helmet shell below a lower edge of the shell and the forward shell opening. As such, the general purpose of the present invention, which will be described subsequently in greater detail, is to provide a new and improved helmet and fluid reservoir apparatus which has all the advantages of the prior art helmet apparatus and none of the disadvantages.

To attain this, the present invention provides a helmet structure including a separably movable fluid pouch mounted within the helmet below the forward helmet shell opening, including an "L" shaped conduit directed upwardly and mounted medially to a respective right and left fluid cavity of the reservoir structure. The organization utilizes hook and loop fastener tabs mounted to a forward surface of the right and left reservoirs for mounting an interior fibrous surface of the helmet shell. A modification of the invention includes a storage tank mounted to the handle bar structure of an associated motorcycle or bicycle construction utilizing a storage tank conduit hose in communication with a valve mounted to the storage tank to direct fluid to the right and left reservoir pouches.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the sprit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved helmet and fluid reservoir apparatus which has all the advantages of the prior art helmet apparatus and none of the disadvantages.

It is another object of the present invention to provide a new and improved helmet and fluid reservoir apparatus which may be easily and efficiently manufactured and marketed.

It is a further object of the present invention to provide a new and improved helmet and fluid reservoir apparatus which is of a durable and reliable construction.

An even further object of the present invention is to provide a new and improved helmet and fluid reservoir apparatus which is susceptible of a low cost of manufacture with regard to both materials and labor, and which accordingly is then susceptible of low prices of sale to the consuming public, thereby making such helmet and fluid reservoir apparatus economically available to the buying public.

Still yet another object of the present invention is to provide a new and improved helmet and fluid reservoir apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
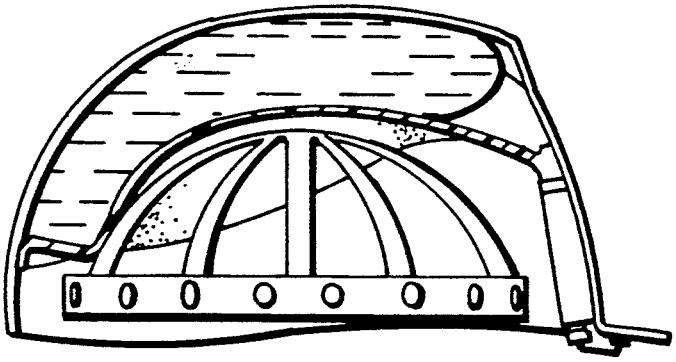
Fig 1 PRIOR ART
FIG. 1 is an orthographic cross-sectional illustration of a prior art helmet and reservoir fluid supply structure.
Figure 2:
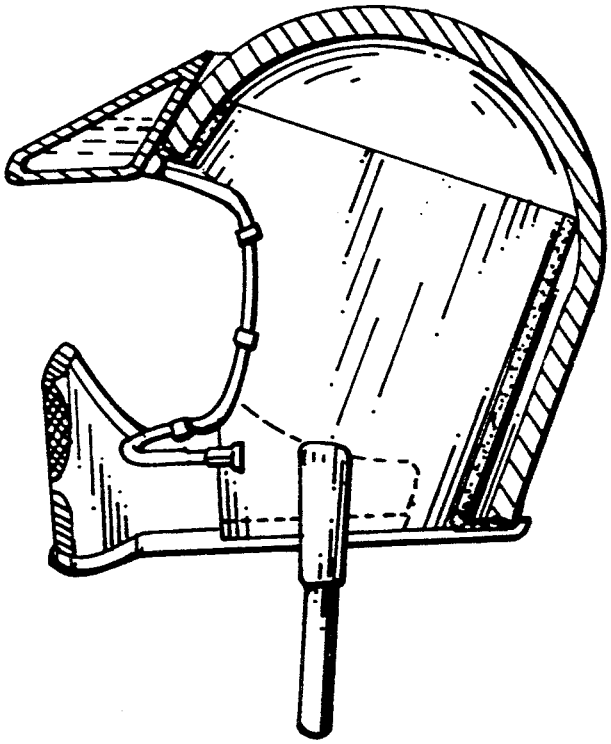
Fig 2 PRIOR ART
FIG. 2 is an orthographic cross-sectional illustration of a further prior art helmet and fluid reservoir apparatus.
Figure 3:
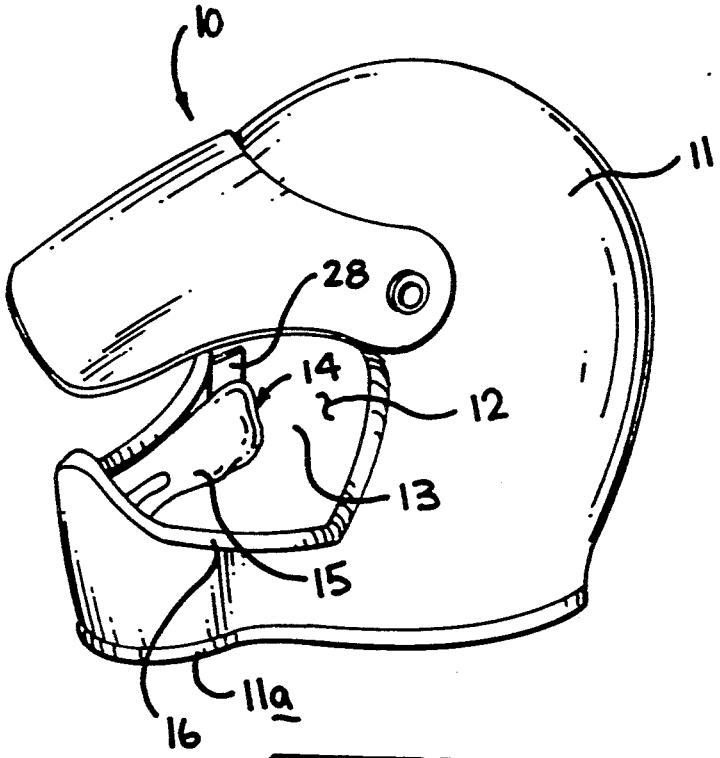
FIG. 3 is an isometric illustration of the instant invention.
Figure 4:
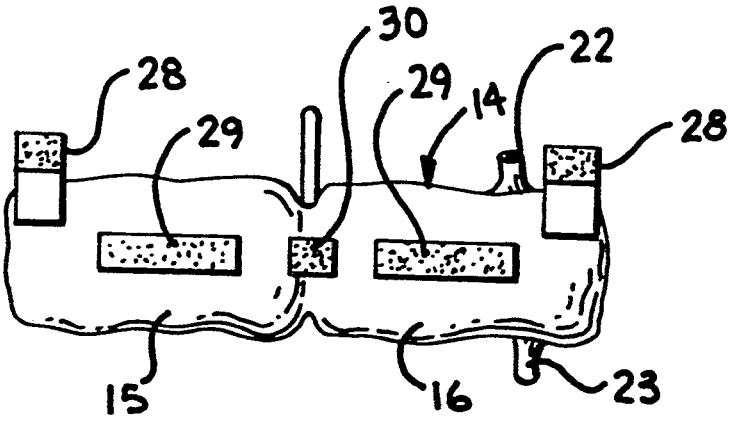
FIG. 4 is an orthographic rear view, taken in elevation, of the flexible reservoir pouch utilized by the invention.
Figure 5:
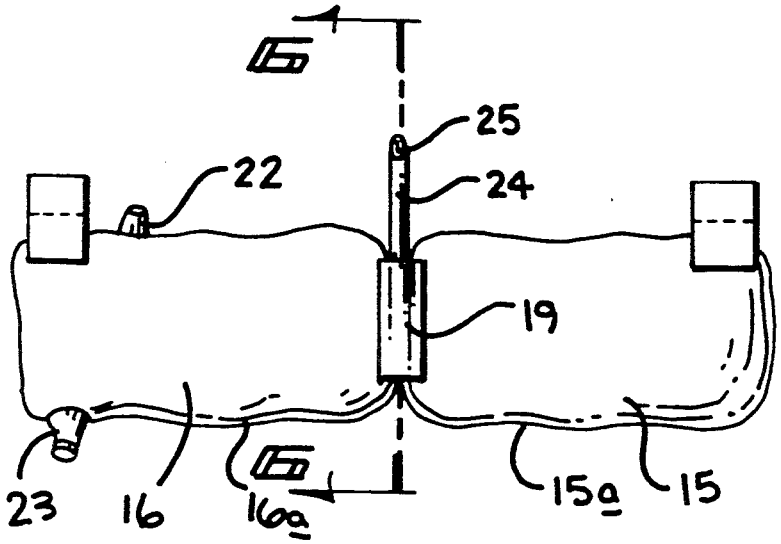
FIG. 5 is an orthographic front view of the fluid reservoir pouch utilized by the invention.
Figure 6:
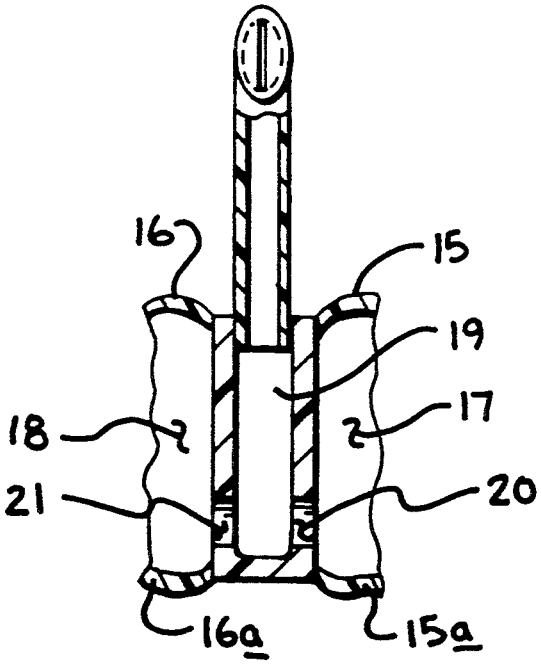
FIG. 6 is an orthographic view, taken along the lines 6—6 of Figure in the direction indicated by the arrows.
Figure 7:
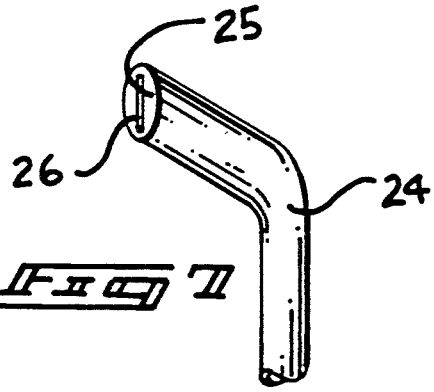
FIG. 7 is an isometric illustration of the "L" shaped drinking conduit in a first configuration effecting closure of the conduit.
Figure 8:
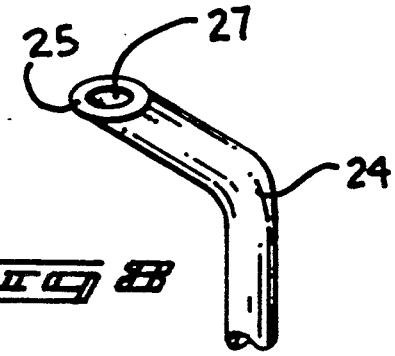
FIG. 8 is an isometric illustration of the "L" shaped conduit in a second configuration depressing the upper end to effect opening of the "L" shaped drinking conduit.

With reference now to the drawings, and in particular to FIGS. 1 to 10 thereof, a new and improved helmet and fluid reservoir apparatus embodying the principles and concepts of the present invention and generally designated by the reference numeral 10 will be described.

FIG. 1 illustrates a prior art helmet structure, as illustrated and set forth in U.S. Pat. No. 4,369,782, wherein an eye washing fluid is contained within a reservoir mounted within an upper portion of the helmet shell of the organization to provide fluid to an eye washing valve relative to the helmet structure. In a like manner, an overhead fluid reservoir is mounted within the helmet structure as set forth in FIG. 2 and discussed in U.S. Pat. No. 4,813,083 wherein the fluid reservoir is mounted within a hollow rigid visor secured to an upper terminal end of the helmet adjacent an upper terminal end of the forward shell opening.

More specifically, the helmet and fluid reservoir apparatus 10 of the instant invention essentially comprises a rigid helmet shell 11 including a lower edge 11*a*, with a forward shell opening 12 directed through the helmet shell above the lower edge 11*a*. The helmet shell 11 includes a continuous fibrous liner 13 formed coextensively within the helmet shell 11. Alternatively, the fibrous liner 13 may be confined to the helmet shell between the shell lower edge 11*a* and the forward shell opening 12. A flexible reservoir pouch 14 is provided to include a respective right and left flexible fluid container to define a respective right and left fluid cavity 17 and 18. The right and left fluid cavities are in fluid communication with a central conduit 19 that is positioned medially of the right and left fluid containers 15 and 16 connecting the respective right and left ends of the containers 15 and 16. A right and left feed conduit 20 and 21 is in fluid communication with a respective right and left fluid cavity 17 and 18 and directed into the central conduit 19 adjacent a lower terminal end thereof. An "L" shaped drinking conduit 24 in fluid communication with the central conduit 19 is directed above the central conduit 19 and terminates in a shape retentive and deformable upper end 25. A fill conduit 22 is directed through an upper edge of the flexible reservoir pouch 14, wherein a fluid release conduit 23 is directed through a left fluid container 16 base 16*a*. Alternatively, the fluid release 23 may be directed through the base portion 15*a* of the right fluid container 15. In use, an individual merely grasps the shape retentive upper end 25 between the individual's teeth to deform the upper end 25 from the first position of the slot 26 to effect closure of the upper end 25 to a second position to define an opening 27 in fluid communication with the central conduit 19.

First right 28 and left 28 hook and loop fastener patches are mounted to the right and left fluid containers 15 and 16 projecting above those containers for securement to the fibrous liner 13. Second hook and loop fastener patches 29 are mounted to the forward face of the flexible reservoir pouch 14 to each fluid container 15 and 16, as well as a third fastener patch 30 positioned medially of the second hook and loop fastener patches 29 to ensure securement of the reservoir pouch 14 to the fibrous liner 13.

Figure 9:
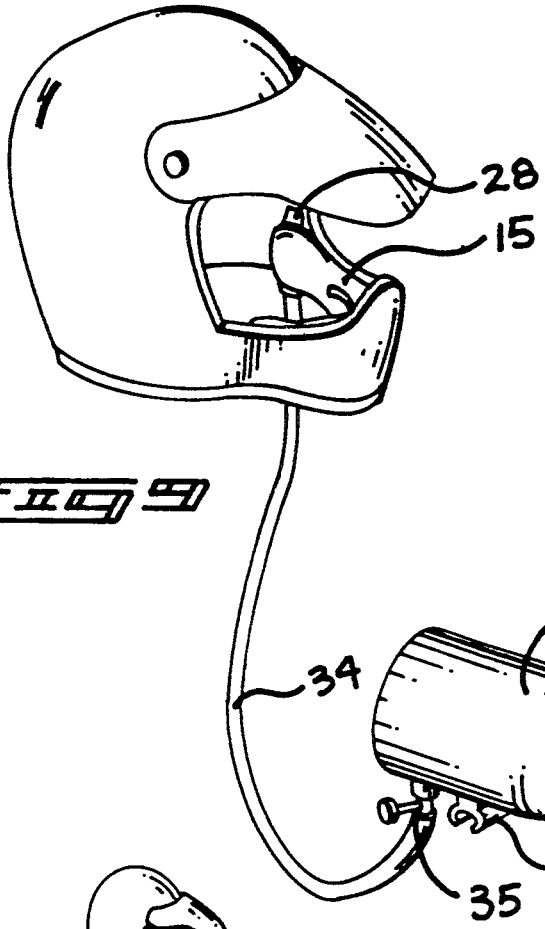
FIG. 9 is an isometric illustration of a modification of the invention.
Figure 10:
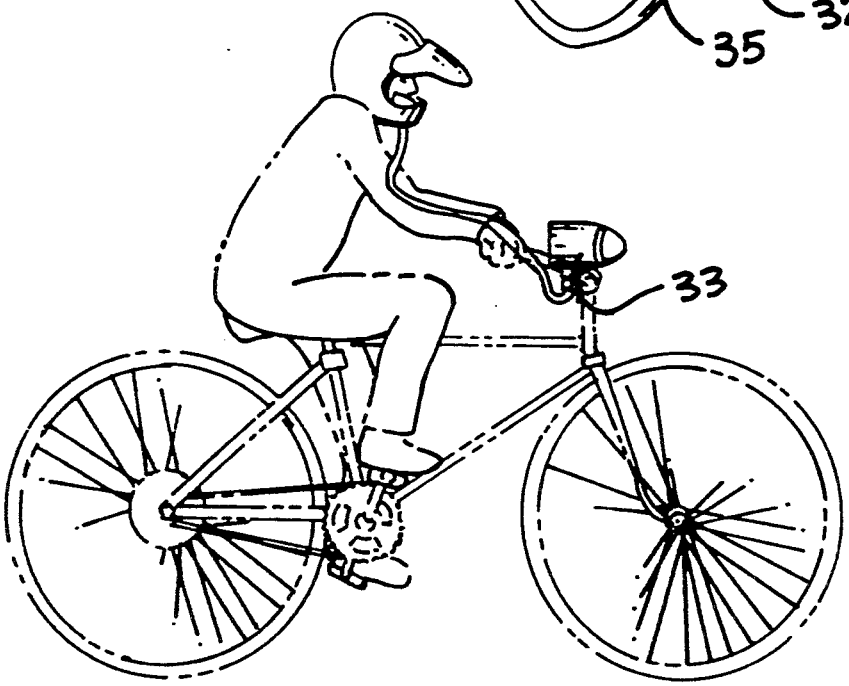
FIG. 10 is an isometric illustration of the modified invention in use.

FIG. 9 illustrates the use of a rigid storage tank 31 that includes a "U" shaped mounting bracket 32 for securement to the handle bars 33 of a bicycle or associated motorcycle apparatus. The rigid storage tank includes a reservoir conduit 34 directed through a valve 35 that in turn is secured to the storage tank 31 to direct fluid from the storage tank 31 through the reservoir conduit 34 into the fluid release conduit 23. In this manner, vacuum directed through the reservoir pouch 14 effects a pulling of fluid through the rigid reservoir conduit 34. Further, vent openings 36 are provided through a top surface of the rigid storage tank 31 to ensure a continuous flow of fluid from the storage tank through the reservoir conduit 34 into the flexible reservoir pouch 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A helmet and fluid reservoir apparatus, comprising, a helmet shell, the helmet shell including a lower continuous edge, and the helmet shell further including a forward shell opening directed through the helmet shell, and a fibrous liner mounted within the helmet shell at least between the shell opening and the lower edge, and a flexible fluid reservoir pouch mounted to the fibrous liner between the lower edge and the forward shell opening, the flexible reservoir pouch including a right flexible fluid container and a left fluid flexible container longitudinally aligned relative to one another and hingedly mounted relative to one another about a central conduit, and the right fluid container and the left fluid container each including a respective right and left first hook and loop fastener patch for securement to the fibrous liner, and the right and left flexible fluid container each including a respective right and left forward face, the respective right and left forward face each including a respective second right and left hook and loop fastener patch for securement to the fibrous liner, and the central conduit including an "L" shaped drinking conduit projecting above the central conduit in fluid communication with the central conduit, the central conduit in fluid communication with the right and left fluid cavity.

2. An apparatus as set forth in claim 1 wherein the central conduit includes a right and left feed conduit for fluid communication of the central conduit relative to the right and left fluid cavity.

3. An apparatus as set forth in claim 2 wherein the "L" shaped drinking conduit includes a shape retentive and deformable upper distal end spaced from the central conduit, the upper end is deformable from a first configuration defining a slot within the upper end to effect closure of the "L" shaped drinking conduit to a second configuration to define a cylindrical opening directed through the upper end to effect fluid communication through the "L" shaped drinking conduit and the upper end.

4. An apparatus as set forth in claim 3 including a fill conduit directed through the reservoir pouch to effect selective filling of the reservoir pouch.

5. An apparatus as set forth in claim 4 including a fluid release conduit directed through a bottom surface of the reservoir pouch, and a rigid storage tank, the rigid storage tank including a "U" shaped mounting bracket for securement of the storage tank to handle bar structure of an associated vehicle, and the storage tank including a valve mounted to the storage tank, and the valve including a reservoir conduit directed from the valve for securement to the fluid release conduit to provide a flow of fluid from the storage tank to the reservoir pouch, and at least one vent opening directed through a top surface of the storage tank to effect venting of the storage tank in directing of fluid from the storage tank to the reservoir pouch.

* * * * *